US011771176B2

(12) United States Patent
Amis et al.

(10) Patent No.: US 11,771,176 B2
(45) **Date of Patent: *Oct. 3, 2023**

(54) FOOTWEAR WITH ALIGNED TENSILE RESTRAINTS

(71) Applicant: NIKE, Inc., Beaverton, OR (US)

(72) Inventors: Sam Amis, Portland, OR (US); Michael S. Amos, Beaverton, OR (US); John Hurd, Lake Oswego, OR (US); James Molyneux, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/871,942

(22) Filed: Jul. 24, 2022

(65) Prior Publication Data

US 2022/0354219 A1 Nov. 10, 2022

Related U.S. Application Data

(63) Continuation of application No. 17/107,706, filed on Nov. 30, 2020, now Pat. No. 11,425,964, which is a (Continued)

(51) Int. Cl.
*A43B 23/02* (2006.01)
*A43C 1/04* (2006.01)
(Continued)

(52) U.S. Cl.
CPC ..... *A43B 23/0265* (2013.01); *A43B 23/0245* (2013.01); *A43C 1/00* (2013.01);
(Continued)

(58) Field of Classification Search
CPC ..... A43B 23/0265; A43B 23/0245; A43B 23/0275; A43C 1/00; A43C 1/04; A43C 1/06; A43C 1/003
(Continued)

(56) References Cited

U.S. PATENT DOCUMENTS 4,353,172 A 10/1982 Bryant
5,909,947 A 6/1999 DeMarchi
(Continued)

FOREIGN PATENT DOCUMENTS

CN 1217169 A 5/1999
CN 102958395 A 3/2013
(Continued)

OTHER PUBLICATIONS

Dec. 15, 2017—International Search Report and Written Opinion—App PCT/US2017/056921.
May 3, 2021—(EP) ESR—App. No. 21154967.0.

*Primary Examiner* — Marie D Bays
(74) *Attorney, Agent, or Firm* — Banner & Witcoff, Ltd.

(57) ABSTRACT

A shoe may include an upper and a sole structure. The upper may include a shell and first, second, third, and fourth sets of tensile restraints. Each of the sets may have one or more tensile restraints extending over and/or through a corresponding portion of the shell. The shell may be engaged with the sole structure and define an interior void configured to receive insertion of a user's foot. The first, second, third, and fourth sets of tensile restraints may be configured so that, upon securing of one or more structures to tighten the upper and connect the sets of tensile restraints, two linear axes of tension with anchors located in the forefoot and heel region extend diagonally across the article from one side to the other.

12 Claims, 12 Drawing Sheets

Related U.S. Application Data continuation of application No. 16/421,747, filed on May 24, 2019, now Pat. No. 10,881,169, which is a continuation of application No. PCT/US2017/056921, filed on Oct. 17, 2017.

(60) Provisional application No. 62/429,288, filed on Dec. 2, 2016.

(51) Int. Cl.
*A43C 1/06* (2006.01)
*A43C 15/16* (2006.01)
*A43C 1/00* (2006.01)

(52) U.S. Cl.
CPC ..... *A43C 1/04* (2013.01); *A43C 1/06* (2013.01); *A43C 15/162* (2013.01)

(58) Field of Classification Search
USPC ..... 36/50.1, 45
See application file for complete search history.

(56) References Cited

U.S. PATENT DOCUMENTS

| | | | | |
|---|---|---|---|---|
| 6,128,835 | A | 10/2000 | Ritter et al. | |
| 9,179,739 | B2 | 11/2015 | Bell et al. | |
| 9,192,204 | B1 | 11/2015 | Liles et al. | |
| 9,420,851 | B2 | 8/2016 | Klug et al. | |
| 10,881,169 | B2 * | 1/2021 | Amis | A43C 1/06 |
| 11,425,964 | B2 * | 8/2022 | Amis | A43C 1/04 |
| 2005/0268487 | A1 | 12/2005 | Ellis | |
| 2007/0277394 | A1 | 12/2007 | Hansen et al. | |
| 2010/0037483 | A1 | 2/2010 | Meschter et al. | |
| 2010/0263236 | A1 | 10/2010 | Carboy et al. | |
| 2011/0041359 | A1 | 2/2011 | Dojan et al. | |
| 2012/0017468 | A1 | 1/2012 | Dojan et al. | |
| 2012/0023778 | A1 | 2/2012 | Dojan et al. | |
| 2012/0023786 | A1 | 2/2012 | Dojan | |
| 2012/0055044 | A1 | 3/2012 | Dojan et al. | |
| 2012/0198727 | A1 | 8/2012 | Long | |
| 2012/0233882 | A1 | 9/2012 | Huffa et al. | |
| 2012/0246973 | A1 | 10/2012 | Dua | |
| 2013/0019500 | A1 | 1/2013 | Greene | |
| 2013/0145652 | A1 | 6/2013 | Podhajny et al. | |
| 2013/0192091 | A1 | 8/2013 | Kohatsu et al. | |
| 2013/0340283 | A1 | 12/2013 | Bell et al. | |
| 2014/0130372 | A1 | 5/2014 | Aveni et al. | |
| 2014/0283412 | A1 | 9/2014 | Elder et al. | |
| 2015/0059209 | A1 | 3/2015 | Dekovic et al. | |
| 2016/0058121 | A1 | 3/2016 | Langvin et al. | |
| 2016/0058127 | A1 | 3/2016 | Burns et al. | |
| 2016/0192741 | A1 | 7/2016 | Mark | |
| 2016/0242498 | A1 | 8/2016 | Sakamoto et al. | |
| 2016/0331083 | A1 | 11/2016 | Uesato | |
| 2019/0037970 | A1 | 2/2019 | Klug et al. | |
| 2019/0313742 | A1 | 10/2019 | Bell et al. | |
| 2020/0315284 | A1 | 10/2020 | Dekovic et al. | |

FOREIGN PATENT DOCUMENTS

| | | | |
|---|---|---|---|
| CN | 103561605 | A | 2/2014 |
| CN | 104080362 | A | 10/2014 |
| CN | 104411196 | A | 3/2015 |
| CN | 104684433 | A | 6/2015 |
| CN | 105578917 | A | 5/2016 |
| CN | 106061308 | A | 10/2016 |
| CN | 106136453 | A | 11/2016 |
| EP | 0471447 | A1 | 2/1992 |
| IT | BZ920021 | A1 | 12/1993 |
| JP | 2003024108 | A | 1/2003 |
| JP | 2007190351 | A | 8/2007 |
| KR | 20070077155 | A | 7/2007 |
| WO | 9005466 | A1 | 5/1990 |
| WO | 2007027062 | A1 | 3/2007 |
| WO | 2011004619 | A1 | 1/2011 |
| WO | 2015038344 | A1 | 3/2015 |

* cited by examiner

FOOTWEAR WITH ALIGNED TENSILE RESTRAINTS

CROSS REFERENCE TO RELATED APPLICATIONS

This application is a continuation of U.S. application Ser. No. 17/107,706, filed Nov. 30, 2020, now allowed, which is a continuation of U.S. application Ser. No. 16/421,747, filed May 24, 2019, now U.S. Pat. No. 10,881,169, which is a continuation of PCT/US2017/056921, filed Oct. 17, 2017, which claims priority to U.S. provisional patent application No. 62/429,288, titled "Footwear With Aligned Tensile Restraints" and filed Dec. 2, 2016. All applications in their entirety, are incorporated by reference herein.

BACKGROUND

Conventional articles of footwear generally include an upper and a sole structure. The sole structure is configured so as to be positioned between the foot and the ground when a wearer of the article is standing, walking or running. The upper provides a covering for the wear's foot and holds the sole structure against that foot.

For many activities, e.g., many types of sports, securely positioning a foot relative to a sole structure is particularly beneficial. In international football, for example, a player may need to suddenly change direction, abruptly stop, or otherwise engage in motions that can be more intense than motions associated with casual walking, etc. If a player's foot is able to move relative to the sole structure of that player's shoe, performance may be degraded.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
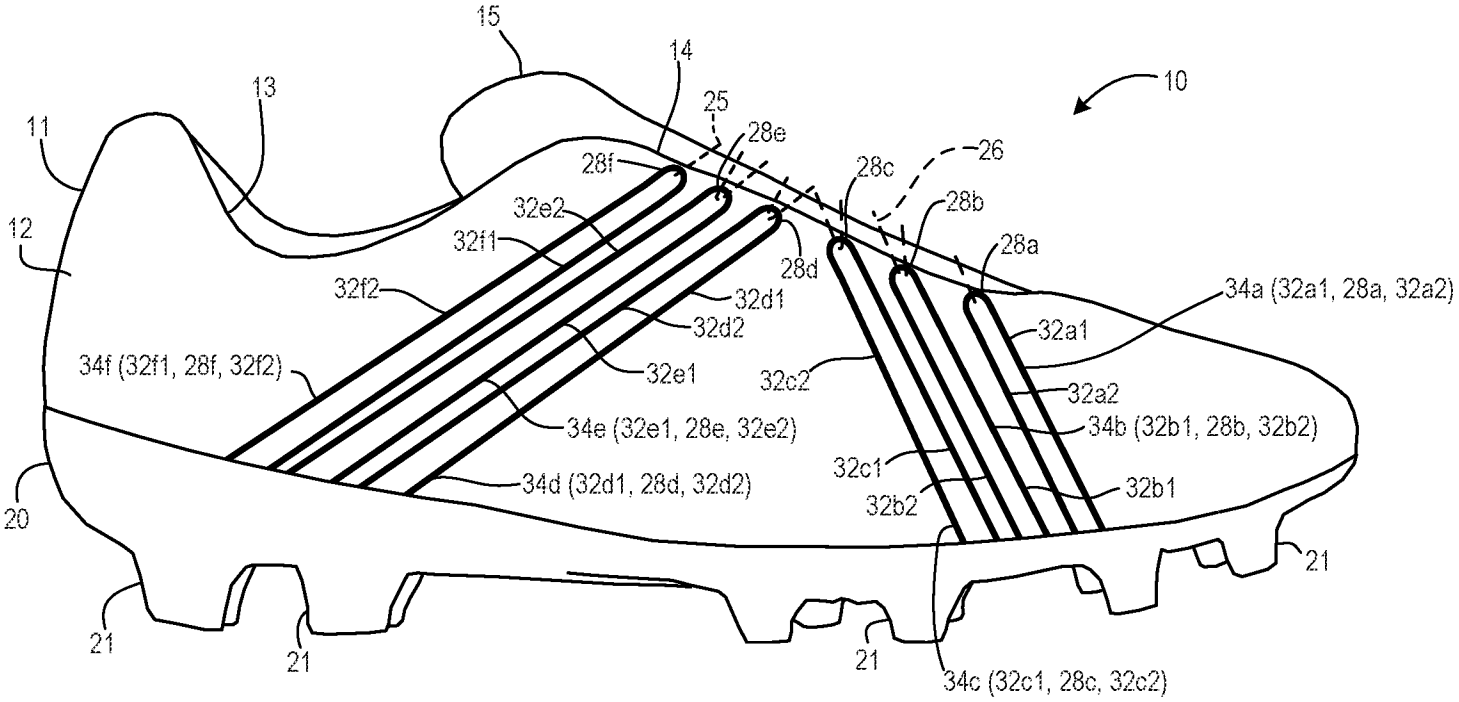
FIG. 1 is a lateral side view of a shoe according to some embodiments.

In at least some embodiments, an article of footwear may include a system of tensile restraints that are arranged to more securely hold a wearer's foot in position relative to a sole structure. The system may include tensile restraints generally aligned from a fore/medial to aft/lateral direction and that form a first axis of tension that is generally linear in the plantar plane and that extends across the upper on a first diagonal, as well as tensile restraints generally aligned from a fore/lateral to aft/medial direction and that form a second axis of tension that is generally linear in the plantar plane and that extends across the upper on a second diagonal. The first and second axes of tension may be the primary tension in the upper (e.g., because of elasticity and/or looseness in other regions of the upper) and may effectively form a four-point harness that secures the foot to the sole structure.

The accompanying drawings and the following description show a shoe designed for footwear worn by a participant in the sport of international style football, which sport is also known as soccer. Unless otherwise indicated, "football" as used herein refers to international style football. Other embodiments include shoes intended for use in other sports or activities (e.g., American style football, rugby, or other sports).

In some embodiments, a shoe may include an upper and a sole structure. The upper may include a shell and first, second, third, and fourth sets of tensile restraints. Each of the sets may have one or more tensile restraints extending over and/or through a corresponding portion of the shell. The shell may be engaged with the sole structure and define an interior void configured to receive insertion of a user's foot. The first, second, third, and fourth sets of tensile restraints may be configured so that, upon securing of one or more laces, one or more straps, and/or one or more other means to tighten the upper and connect the sets of tensile restraints, two linear axes of tension with anchors located in the forefoot and heel region extend diagonally across the article from one side to the other.

In some embodiments, a shoe may include an upper and a sole structure. The upper may include a shell and first, second, third, and fourth sets of tensile restraints. Each of the sets may have one or more tensile restraints extending over and/or through a corresponding portion of the shell. The shell may be engaged with the sole structure and define an interior void configured to receive insertion of a user's foot. The first set of tensile restraints and the fourth set of tensile restraints may be aligned on a first diagonal path having a projection in a plantar plane that extends linearly from a medial forefoot region to a lateral heel region. The second set of tensile restraints and the third set of tensile restraints may be aligned on a second diagonal path having a projection in the plantar plane that extends linearly from a lateral forefoot region toward a medial heel region.

In some embodiments, an upper for an article of footwear may include a shell and first, second, third, and fourth sets of tensile restraints. Each of the sets may have one or more tensile restraints extending across a corresponding portion of the shell. The one or more tensile restraints of the first set may extend from a medial phalangeal or tarso-phalangeal region of the shell to an instep region of the shell. The one or more tensile restraints of the second set may extend from a lateral phalangeal or tarso-phalangeal region of the shell to the instep region of the shell. The one or more tensile restraints of the third set may extend from a medial heel region of the shell to the instep region of the shell. The one or more tensile restraints of the fourth set may extend from a lateral heel region of the shell to the instep region of the shell. A rearward-most tensile restraint of the first set and a forward-most tensile restraint of the third set may bound a region of the shell medial side lacking any tensile restraints extending between a bottom edge of the shell and the instep region. A rearward-most tensile restraint of the second set and a forward-most tensile restraint of the fourth set may bound a region of the shell lateral side lacking any tensile restraints extending between the bottom edge of the shell and the instep region.

In some embodiments, a shoe may include a sole structure and an upper. The upper may include a shell and first, second, third, and fourth sets of tensile restraints. Each of the sets may have one or more tensile restraints extending over and/or through a corresponding portion of the shell. The shell may be engaged with the sole structure and define an interior void configured to receive insertion of a user's foot. The one or more tensile restraints of the first set may be coupled to a first anchor region located in a medial forefoot portion of the article and to a forward part of a medial side of an instep region of the upper. The one or more tensile restraints of the second set may be coupled to a second anchor region located in a lateral forefoot portion of the article and to a forward part of a lateral side of the instep region. The one or more tensile restraints of the third set may be coupled to a third anchor region located in a medial heel portion of the article and to a rear part of the medial side of the instep region. The one or more tensile restraints of the fourth set may be coupled to a fourth anchor region located in a lateral heel portion of the article and to a rear part of the lateral side of the instep region. The tensile restraints of the first and third sets may be the only tensile restraints extending between the sole structure and the medial side of the instep region. The tensile restraints of the second and fourth sets may be the only tensile restraints extending between the sole structure and the lateral side of the instep region.

In some embodiments, a shoe may include an upper and a sole structure. The upper may include a shell and first, second, third, and fourth sets of tensile restraints. Each of the sets may have one or more tensile restraints extending over and/or through a corresponding portion of the shell. The shell may be engaged with the sole structure and define an interior void configured to receive insertion of a user's foot. The one or more tensile restraints of the first set may be coupled to a first anchor region located in a medial forefoot portion of the article and to a forward part of a medial side of an instep region of the shell. The one or more tensile restraints of the second set may be coupled to a second anchor region located in a lateral forefoot portion of the article and to a forward part of a lateral side of the instep region. The one or more tensile restraints of the third set may be coupled to a third anchor region located in a medial heel portion of the article and to a rear part of the medial side of the instep region. The one or more tensile restraints of the fourth set may be coupled to a fourth anchor region located in a lateral heel portion of the article and to a rear part of the lateral side of the instep region. The first, second, third, and fourth sets may be configured so that, upon cinching of lace segments connecting the medial and the lateral sides of the instep region, two linear axes of tension with anchors located in the forefoot and heel region extend diagonally across the article from one side to the other.

In some embodiments, a shoe may include an upper and a sole structure. The upper may include a shell, one or more laces, and first, second, third, and fourth sets of tensile restraints. Each of the sets may have one or more tensile restraints extending over and/or through a corresponding portion of the shell. The shell may be engaged with the sole structure and define an interior void configured to receive insertion of a user's foot. The shell may include first lace retainers on a medial side of an instep region, second lace retainers on a lateral side of the instep region, third lace retainers on the medial side of the instep region rearward of the first and second lace retainers, and fourth lace retainers on the lateral side the instep region rearward of the first and second lace retainers. The one or more tensile restraints of the first set may be coupled to a first anchor region located in a medial forefoot portion of the article and to the first lace retainers. The one or more tensile restraints of the second set may be coupled to a second anchor region located in a lateral forefoot portion of the article and to the second lace retainers. The one or more tensile restraints of the third set may be coupled to a third anchor region located in a medial heel portion of the article and to the third lace retainers. The one or more tensile restraints of the fourth set may be coupled to a fourth anchor region located in a lateral heel portion of the article and to the fourth lace retainers. Each of the first lace retainers may be directly connected by a segment of the one or more laces with one of the fourth lace retainers. Each of the fourth lace retainers may be directly connected by a segment of the one or more laces with one of the first lace retainers. Each of the second lace retainers may be directly connected by a segment of the one or more laces with one of the third lace retainers. Each of the third lace retainers may be directly connected by a segment of the one or more laces with one of the second lace retainers.

Additional embodiments are described herein.

To assist and clarify subsequent description of various embodiments, various terms are defined herein. Unless context indicates otherwise, the following definitions apply throughout this specification (including the example embodiments included in the list of example embodiments attached hereto). "Shoe" and "article of footwear" are used interchangeably to refer to an article intended for wear on a human foot. A shoe may or may not enclose the entire foot of a wearer.

Shoe elements can be described based on regions and/or anatomical structures of a human foot wearing that shoe, and by assuming that the interior of the shoe generally conforms to and is otherwise properly sized for the wearing foot. A forefoot region of a foot includes the phalanges, as well as the heads and bodies of the metatarsals. A forefoot element of a shoe is an element having one or more portions located under, over, to the lateral and/or medial side of, and/or in front of a wearer's forefoot (or portion thereof) when the shoe is worn. A midfoot region of a foot includes the cuboid, navicular, and cuneiforms, as well as the bases of the metatarsals. A midfoot element of a shoe is an element having one or more portions located under, over, and/or to the lateral and/or medial side of a wearer's midfoot (or portion thereof) when the shoe is worn. A heel region of a foot includes the talus and the calcaneus. A heel element of a shoe is an element having one or more portions located under, to the lateral and/or medial side of, and/or behind a wearer's heel (or portion thereof) when the shoe is worn. The forefoot region may overlap with the midfoot region, as may the midfoot and heel regions.

For purposes of describing axes and directions for a sole structure, it is assumed that at least heel and midfoot surfaces of a sole structure intended for ground contact are resting on a horizontal reference plane. It is further assumed that studs or other projections from a bottom side of a sole structure do not penetrate that reference plane, and that the sole structure is not deformed. A longitudinal axis refers to a horizontal heel-toe axis that extends from a forward-most toe location on shoe (e.g., "FT" in FIG. 3) to a rearmost heel location on that shoe (e.g., "RH" in FIG. 3). A longitudinal axis may be inclined with regard to the reference plane. A longitudinal direction is parallel to the longitudinal axis. A transverse axis is an axis that intersects and is perpendicular to the longitudinal axis, and that is also parallel or approximately parallel to the reference plane. A transverse direction is a direction along a transverse axis. A plantar plane is parallel to the reference plane.

"Upper," when used as a noun, refers to a portion of a shoe that provides a covering for some or all of a wearer's foot and that positions that foot relative to a sole structure of that shoe. A "bottom side" of a shoe (or component thereof) refers to a side of a shoe (or component thereof) that faces towards the reference plane. A "top side" of a shoe (or component thereof) refers to a side of a shoe (or component thereof) that faces away from the reference plane.

Throughout the following detailed description and in the accompanying drawing figures, multiple components, portions, regions, or other items may be identified using a common reference number, but with different letters (or letter/number combinations) appended to distinguish among specific individual items. For example, embodiments include an article of footwear having an upper with lateral side lace retainers 27*a* through 27*f* and medial side lace retainers 28*a* through 28*f*. Items identified in this manner may be identified collectively or generically using only a number portion of the reference (e.g., "lace retainers 27").

Figure 2:
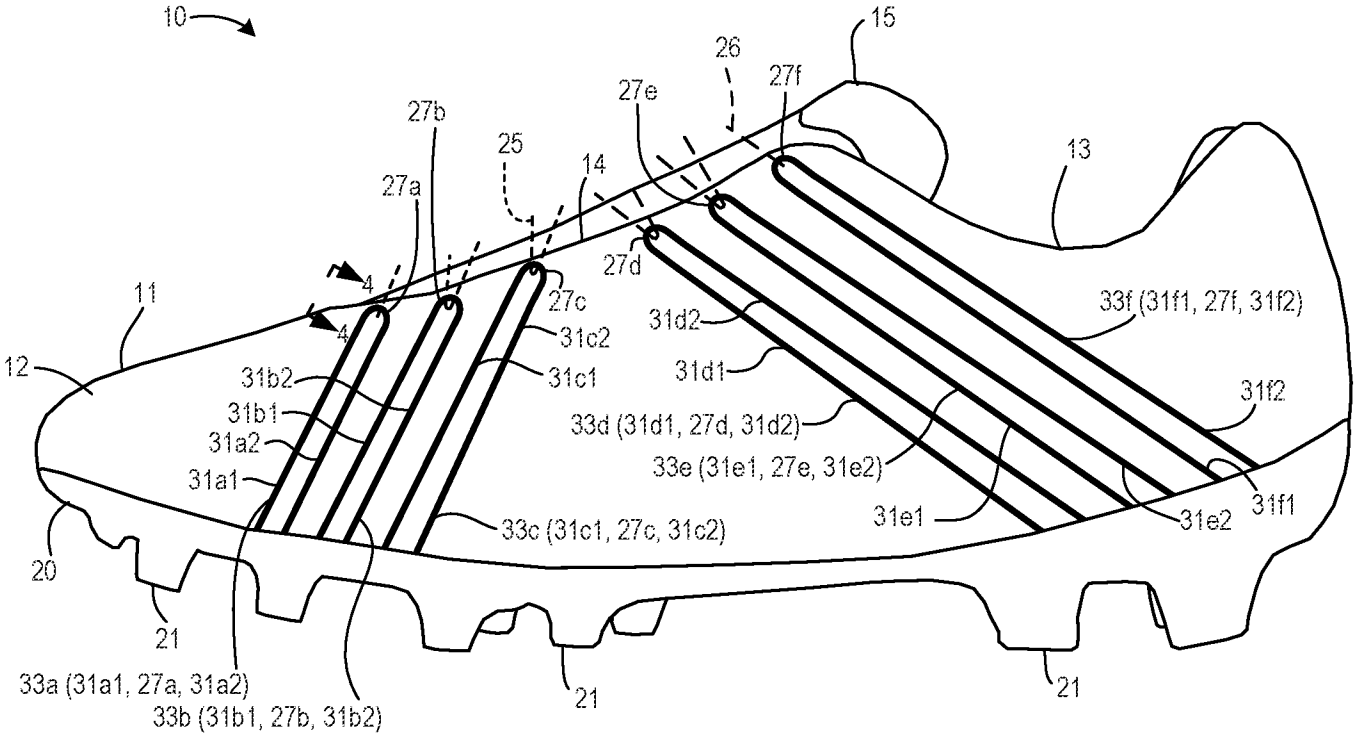
FIG. 2 is a medial side view of the shoe of FIG. 1.
Figure 3:
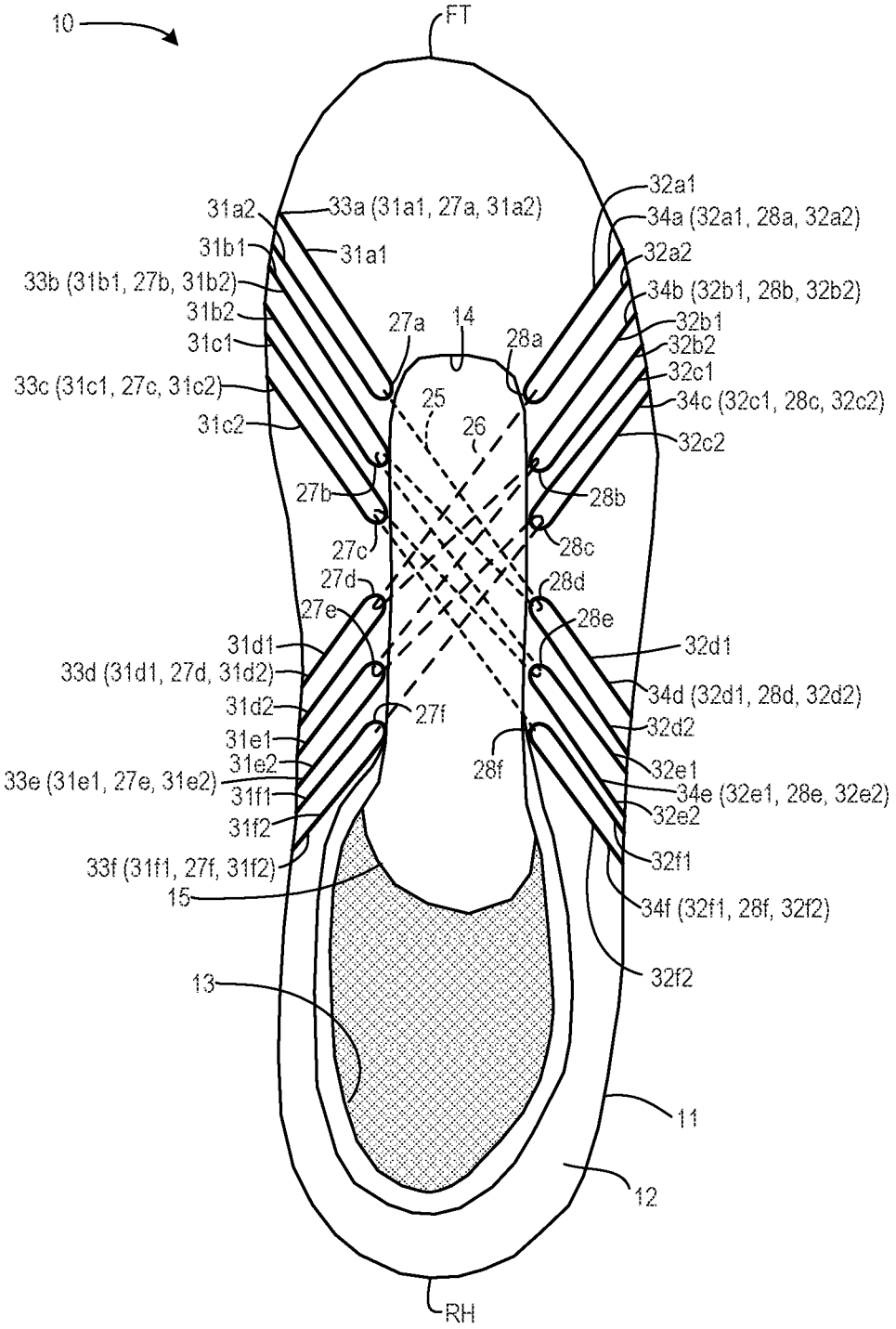
FIG. 3 is a top view of the shoe of FIG. 1.

FIG. 1 is a lateral side view of a shoe 10 according to some embodiments. Shoe 10 is configured for wear by a participant in the sport of football. FIG. 2 is a medial side view of shoe 10. FIG. 3 is a top view of shoe 10. Shoe 10 is configured for wear on a right foot and is part of a pair that includes a shoe (not shown) that is a mirror image of shoe 10 and configured for wear on a left foot. Shoe 10 includes an upper 11 that defines a void configured to receive insertion of a user's foot. Upper 11 includes a shell 12 having an ankle opening 13 that merges into a tongue opening 14 in an instep region. A tongue 15 extends across tongue opening 14. Upper 11 may be formed from any of various types of material and may have any of a variety of different constructions. For example, shell 12 and tongue 15 may be formed from natural or synthetic leather, from one or more woven or knitted textile materials, from sheets of polymer materials such as thermoplastic polyurethane (TPU), and from other materials commonly used for footwear uppers, as well as combinations of one or more of leather, textile, polymer sheet, and/or other materials.

The void defined by upper 11 includes space into which a wearer foot is received via ankle opening 13, and may also include space for an insole, an internal midsole, or other internal components. Shell 12 and/or tongue 15 may also include padding (e.g., open-cell polymer foam) in one or more regions. As explained below, the bottom of upper 11 is enclosed by a lasting element (e.g., a strobel) that is stitched or otherwise attached to a bottom edge of shell 12.

Upper 11 is engaged with a sole structure 20. In the embodiment of shoe 10, the lasting element of upper 11 and the lower regions of shell 12 are bonded to a top surface of sole structure 20. The bottom of sole structure 20 is an outsole and includes multiple cleats 21 positioned to engage a ground surface when shoe 10 is in use. Sole structure 20 may be molded from TPU, polyurethane, and/or other materials and/or may include one or more stiffening plates or regions formed from a composite (e.g., carbon, glass, or other type fibers bound in a polymer matrix) or other type of stiffening material. In some embodiments, a sole structure may include a separate midsole element positioned between an outsole and an upper (e.g., with the outsole bonded to the midsole and the midsole bonded to the upper), which midsole element may be formed from compressed closed cell ethylene vinyl acetate (EVA) foam and/or from one or more other materials. An insole and/or internal cushioning midsole may also be located within upper 11 in some embodiments.

Upper 11 can be cinched about a wearer foot by tightening one or more laces. In some embodiments, upper 11 has two separate laces 25 and 26. For convenience, laces 25 and 26 are represented in the drawings using two different types of broken lines. Medial side lace retainers 27*a* through 27*f* and lateral side lace retainers 28*a* through 28*f* engage laces 25 and 26, as discussed in more detail below. Lace retainers 27*a*, 27*b*, and 27*c* constitute a first group of lace retainers and are located on a medial side of a forward portion of the instep region adjacent tongue opening 14. Lace retainers 28*a*, 28*b*, and 28*c* constitute a second group of lace retainers and are located on a lateral side of the forward portion of the instep region adjacent tongue opening 14. Lace retainers 27*d*, 27*e*, and 27*f* constitute a third group of lace retainers and are located on a medial side of a rear portion of the instep region adjacent tongue opening 14. Lace retainers 28*d*, 28*e*, and 28*f* constitute a fourth group of lace retainers and are located on a lateral side of the rear portion of the instep region adjacent tongue opening 14. The first and third groups of lace retainers do not overlap. For example, the rearmost lace retainer 27*c* of the first group is located forward of the forwardmost lace retainer 27*d* of the third group. Similarly, the second and fourth groups of lace retainers do not overlap. Rearmost lace retainer 28*c* of the second group is located forward of the forwardmost lace retainer 28*d* of the fourth group.

Upper 11 further includes medial side tensile restraints 31 and lateral side tensile restraints 32. As used herein, a tensile restraint is an element having a length that is substantially greater than the width of that element and substantially greater than the thickness of that element. In some embodiments, "substantially greater" means at least 200% greater. In some embodiments, "substantially greater" means at least 500% greater, at least 800% greater, at least 1000% greater, or at least at least 1000% greater. In some embodiments, a largest dimension of a cross-section of a tensile restraint, taken in a plane perpendicular to a lengthwise axis of the tensile element, is no greater than one tenth of the length of the tensile element.

In some embodiments, a tensile restraint may also have a greater tensile strength, and be less extensible than, the material of a shell over which the tensile restraint lies and/or through which the tensile restraint passes. In the embodiment of shoe 10, each of tensile elements 31 and 32 is a single strand. Materials that can be used for such a strand include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. Filaments may have an indefinite length such that each of one or more filaments making up a strand extends the entire length of that strand. Fibers have a relatively short length and generally go through spinning or twisting processes to produce a strand of suitable length. An individual filament utilized in a strand may be formed form a single material (i.e., a monocomponent filament) or from multiple materials (i.e., a bi- or multicomponent filament). Different filaments may be formed from different materials. As one example, yarns utilized in strands may include filaments that are each formed from a common material and/or may include filaments that are each formed from two or more different materials. Similar concepts also apply to threads, cables, or ropes. The thickness of a strand may also vary significantly to range from less than 0.03 millimeters to more than 5 millimeters, for example. Although a strand or other tensile element may have a cross-section where width and thickness are substantially equal (e.g., a round or square cross-section), a strand or other tensile element may have a width that is greater than a thickness (e.g., a rectangular, oval, or otherwise elongate cross-section).

In some embodiments, a strand used for one or more tensile restraints may be a braided cable that comprises from 8 to 16 individual yarns (ends). Examples of materials from which such yarns may be formed include high tenacity polyester (HT polyester), high tenacity nylon (HT nylon), and ultra high molecular weight polyethylene (UHMWPE). A core yarn may optionally be included. A core yarn may be the same type of yarn used for other yarns in the braided cable, or may be a type of yarn that is different from other yarns in the braided cable. In some embodiments, a braided cable strand may have a diameter between 0.8 millimeters (mm) and 1.5 mm, a tensile strength between 15 kilograms force (kgf) and 60 kgf, and an elongation between 5% and 40%. Non-limiting specific examples of such braided cables are set forth in Table 1.

TABLE 1

| Example | Yarn Mat'l | Diam. (mm) | Tensile Str. (kgf) | Elong. (%) |
|---|---|---|---|---|
| 1 | HT polyester | 1.0 | 21 | 12 |
| 2 | HT nylon | 0.8 | 24 | 17 |
| 3 | HT polyester | 1.2 | 22 | 38 |
| 4 | HT polyester with UHMWPE core | 1.2 | 53 | 6 |

Tensile restraints 31*a*1 through 31*c*2 constitute a first set of tensile restraints and are located on a medial side of upper 11. Each of tensile restraints 31*a*1 through 31*c*2 extends from a first anchor region to one of the lace retainers 27*a*, 27*b*, or 27*c* of the first group. The first anchor region may be located under the footbed in the medial forefoot region of shoe 10 and between upper 11 and sole structure 20, as discussed below in connection with FIG. 5. In the embodiment of shoe 10, each lace retainer is a loop formed between segments of a single strand. For example, tensile restraints 31*a*1 and 31*a*2 and lace retainer 27*a* are different parts of a single continuous strand 33*a*. A first segment of strand 33*a* forms tensile restraint 31*a*1 and extends from the first anchor region to a location near a medial edge of tongue opening 14. A second segment of strand 33*a* is formed into a loop that constitutes lace retainer 27*a*. A third segment of strand 33*a* forms tensile restraint 31*a*2 and extends from the loop of lace retainer 27*a* to the first anchor region.

Tensile restraints 31*b*1 and 31*b*2 and lace retainer 27*b* may be formed from a single strand 33*b* and have a configuration similar to that of tensile restraints 31*a*1 and 31*a*2 and lace retainer 27*a*. Tensile restraints 31*c*1 and 31*c*2 and lace retainer 27*c* may be formed from a single strand 33*c* and have a configuration similar to that of tensile restraints 31*a*1 and 31*a*2 and lace retainer 27*a*.

Tensile restraints 32*a*1 through 32*c*2 constitute a second set of tensile restraints and are located on a lateral side of upper 11. Each of tensile restraints 32*a*1 through 32*c*2 extends from a second anchor region to one of the lace retainers 28*a*, 28*b*, or 28*c* of the second group. The second anchor region may be located under the footbed in the lateral forefoot region of shoe 10 and between upper 11 and sole structure 20. Tensile restraints 32*a*1 and 32*a*2 and lace retainer 28*a* may be formed from a single strand 34*a* and have a configuration similar to that of tensile restraints 31*a*1 and 31*a*2 and lace retainer 27*a*. Tensile restraints 32*b*1 and 32*b*2 and lace retainer 28*b* may be formed from a single strand 34*b* and have a configuration similar to that of tensile restraints 31*a*1 and 31*a*2 and lace retainer 27*a*. Tensile restraints 32*c*1 and 32*c*2 and lace retainer 28*c* may be formed from a single strand 34*c* and have a configuration similar to that of tensile restraints 31*a*1 and 31*a*2 and lace retainer 27*a*.

Tensile restraints 31*d*1 through 31*f*2 constitute a third set of tensile restraints and are located on the medial side of upper 11. Each of tensile restraints 31*d*1 through 31*f*2 extends from a third anchor region to one of lace retainers 27*d*, 27*e*, or 27*f* of the third group. The third anchor region may be located under the footbed in the medial heel region of shoe 10 and between upper 11 and sole structure 20. Tensile restraints 31*d*1 and 31*d*2 and lace retainer 27*d* may be formed from a single strand 33*d* and have a configuration similar to that of tensile restraints 31*a*1 and 31*a*2 and lace retainer 27*a*. Tensile restraints 31*e*1 and 31*e*2 and lace retainer 27*e* may be formed from a single strand 33*e* and have a configuration similar to that of tensile restraints 31*a*1 and 31*a*2 and lace retainer 27*a*. Tensile restraints 31*f*1 and 31*f*2 and lace retainer 27*f* may be formed from a single strand 33*f* and have a configuration similar to that of tensile restraints 31*a*1 and 31*a*2 and lace retainer 27*a*.

Tensile restraints 32*d*1 through 32*f*2 constitute a fourth set of tensile restraints and are located on the lateral side of upper 11. Each of tensile restraints 32*d*1 through 32*f*2 extends from a fourth anchor region to one of the lace retainers 28*d*, 28*e*, or 28*f* of the fourth group. The fourth anchor region may be located under the footbed in the medial heel region of shoe 10 and between upper 11 and sole structure 20. Tensile restraints 32*d*1 and 32*d*2 and lace retainer 28*d* may be formed from a single strand 34*d* and have a configuration similar to that of tensile restraints 31*a*1 and 31*a*2 and lace retainer 27*a*. Tensile restraints 32*e*1 and 32*e*2 and lace retainer 28*e* may be formed from a single strand 34*e* and have a configuration similar to that of tensile restraints 31*a*1 and 31*a*2 and lace retainer 27*a*. Tensile restraints 32*f*1 and 32*f*2 and lace retainer 28*f* may be formed from a single strand 34*f* and have a configuration similar to that of tensile restraints 31*a*1 and 31*a*2 and lace retainer 27*a*.

As can be appreciated form the above, upper 11 includes shell 12 and the first, second, third, and fourth sets of tensile restraints. The tensile restraints 31*a*1 through 31*c*2 of the first set may extend from a medial phalangeal and/or from a medial tarso-phalangeal region of shell 12 to an instep region of shell 12. The tensile restraints 32*a*1 through 32*c*2 of the second set may extend from a lateral phalangeal and/or from a lateral tarso-phalangeal region of shell 12 to the instep region of shell 12. The tensile restraints 31*d*1 through 31*f*2 of the third set may extend from a medial heel region of shell 12 to the instep region of shell 12. The tensile restraints 32*d*1 through 32*f*2 of the fourth set may extend from a lateral heel region of shell 12 to the instep region of shell 12. The rearward-most tensile restraint 31*c*2 of the first set and the forward-most tensile restraint 31*d*1 of the third set bound a region of the shell 12 medial side lacking any tensile restraints extending between a bottom edge of shell 12 and the instep region. The rearward-most tensile restraint 32*c*2 of the second set and the forward-most tensile restraint 32*d*1 of the fourth set bound a region of the shell 12 lateral side lacking any tensile restraints extending between the bottom edge of shell 12 and the instep region.

Figure 4:
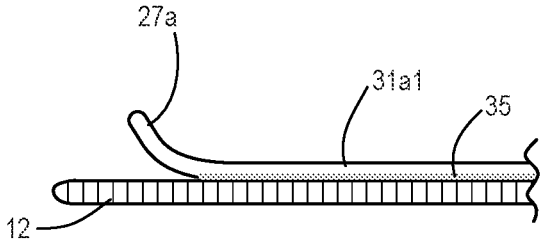
FIG. 4 is a partial cross-sectional view from the location indicated in FIG. 2.

Some or all portions of strands 33 and 34 that form the parts of tensile restraints 31 and 32 overlaying shell 12 may be bonded to an exterior surface of shell 12. Such bonding may be omitted from the portion of strands 33 and 34 forming lace retainers 27 and 28. One example of this is shown in FIG. 4, an enlarged, partially schematic cross-sectional view from the location indicated in FIG. 2. As seen in FIG. 4, the portion of strand 33*a* forming tensile restraint 31*a*1 is secured to the exterior surface of shell 12 by bonding material 35. Bonding material 35 may be, e.g., an adhesive or a fused polymer (e.g., melted and solidified TPU). The portion of strand 33*a* forming tensile restraint 31*a*2 may be bonded to the exterior surface of shell 12 in a similar manner. The portion of strand 33*a* forming lace retainer 27*a* is not bonded to the exterior surface of shell 12 and may be movable away from that surface so as to allow passage or connection of a lace. Other strands 33 and 34 may be bonded to shell 12 in a similar manner.

Figure 5:
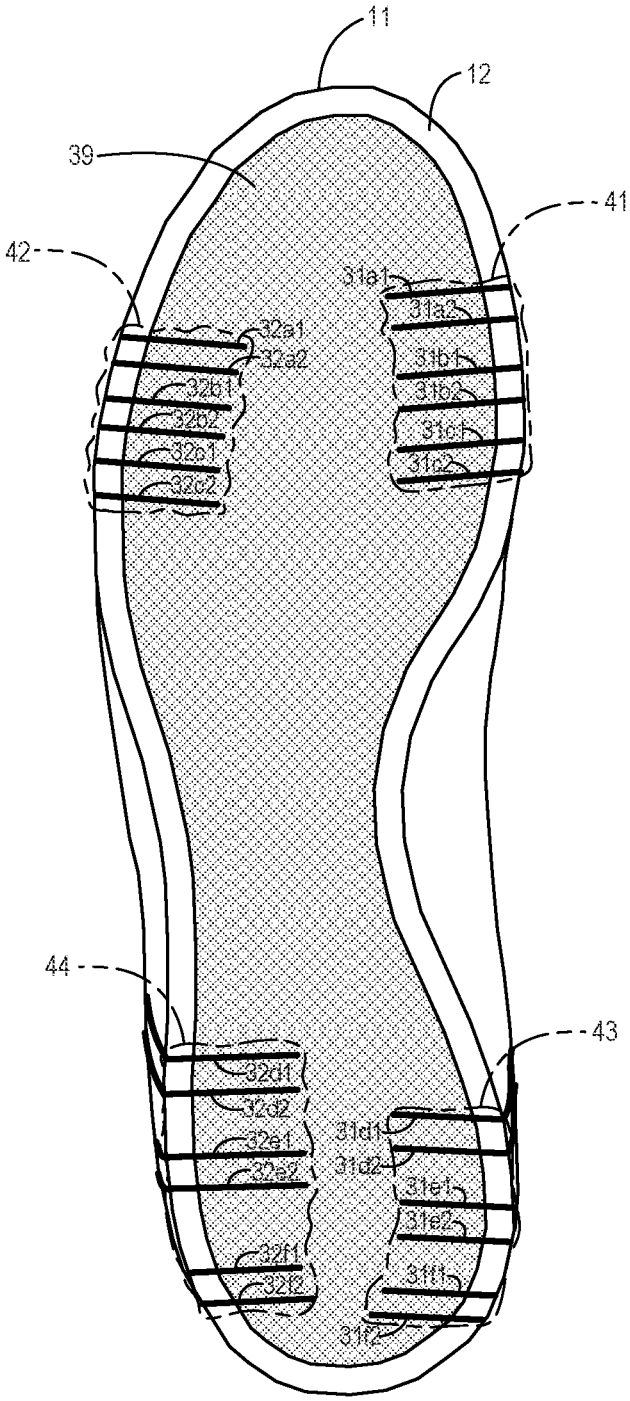
FIG. 5 is a bottom view of the shoe of FIG. 1 with the sole structure omitted.

FIG. 5 is a bottom view of shoe 10 with sole structure 20 omitted to reveal lasting element 39 and the first through fourth anchor regions mentioned above. As indicated above, lasting element 39 may be stitched or otherwise attached to a bottom edge of shell 12 so as to form the bottom of upper 11. Tensile restraints 31*a*1 through 31*c*2 of the first set are bonded to lasting element 39 and/or to a bottom edge portion of shell 12 in the first anchor region 41 located in the medial forefoot region. Tensile restraints 32*a*1 through 32*c*2 of the second set are bonded to lasting element 39 and/or to a bottom edge portion of shell 12 in the second anchor region 42 located in the lateral forefoot region. Tensile restraints 31*d*1 through 31*f*2 of the third set are bonded to lasting element 39 and/or to a bottom edge portion of shell 12 in the third anchor region 43 located in the medial heel region. Tensile restraints 32*d*1 through 32*f*2 of the fourth set are bonded to lasting element 39 and/or to a bottom edge portion of shell 12 in the fourth anchor region 44 located in the lateral heel region. When the bottom of upper 11 is bonded to a top surface of sole structure 20, the tensile restraints may also be bonded to that top surface of sole structure 20.

Figure 6:
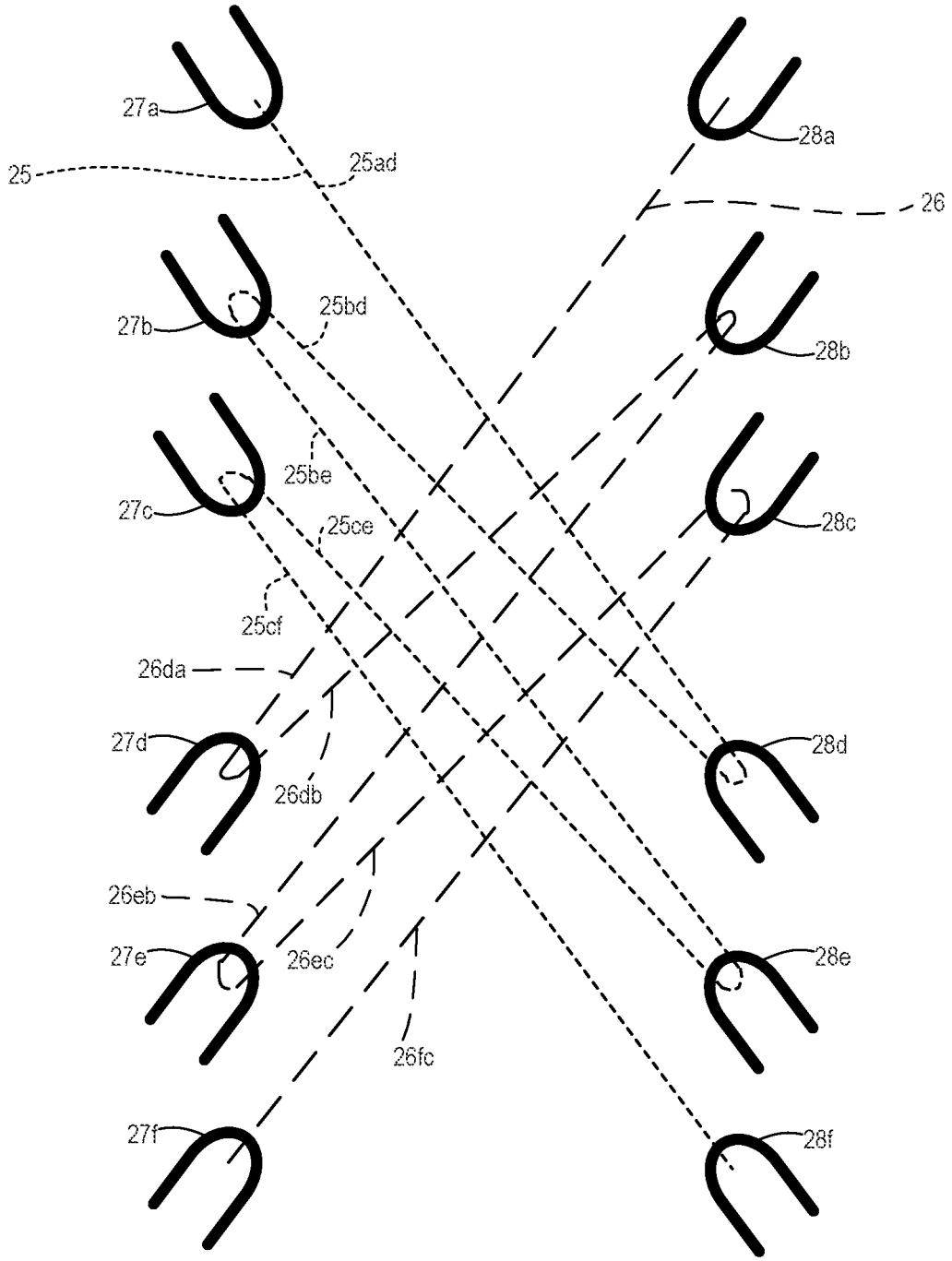
FIG. 6 is a schematic drawing of a configuration of laces according to some embodiments.

FIG. 6 is a schematic drawing of a configuration of laces 25 and 26 according to some embodiments. In FIG. 6, medial side lace retainers 27*a* through 27*f* and lateral side lace retainers 28*a* through 28*f* are represented in the same relative positions shown in FIG. 3, but in a slightly enlarged form. The forward end of lace 25 is secured to lace retainer 27*a*. Although not shown, the manner of securement may be a knot, a clip or other mechanical fastener, an adhesive, a fused polymer bonding, or other suitable means. Lace 25 then passes through lace retainers 28*d*, 27*b*, 28*e*, and 27*c*, with the rear end of lace 25 being adjustably secured to lace retainer 28*f*. In a similar manner, the forward end of lace 26 is secured to lace retainer 28*a*. Lace 26 then passes through lace retainers 27*d*, 28*b*, 27*e*, and 28*c*, with the rear end of lace 26 being adjustably secured to lace retainer 27*f*. So that laces 25 and 26 may be tightened, the securements of lace 25 to lace retainer 28*f* and of lace 26 to lace retainer 27*f* may be by way of adjustable clamps (also not shown).

In the configuration shown in FIG. 6, each of medial side lace retainers 27*a*, 27*b*, and 27*c* of the first group is directly connected to one or more of lateral side lace retainers 28*d*, 28*e*, and 28*f* of the fourth group by a segment of lace 25, and vice versa. For example, lace retainer 27*a* is directly connected to lace retainer 28*d* by a segment 25*ad* of lace 25. The connection is direct because segment 25*ad* extends between lace retainers 27*a* and 28*d* without passing through any intervening lace retainer. Other direct connections between first and fourth group lace retainers include connections between lace retainers 28*d* and 27*b* (segment 25*bd*), between lace retainers 27*b* and 28*e* (segment 25*be*), between lace retainers 28*e* and 27*c* (segment 25*ce*), and between lace retainers 27*c* and 28*f* (segment 25*cf*).

In a similar manner, each of lateral side lace retainers 28*a*, 28*b*, and 28*c* of the second group is directly connected to one or more of medial side lace retainers 27*d*, 27*e*, and 27*f* of the third group by a segment of lace 26, and vice versa. Those direct connections include connections between lace retainers 28*a* and 27*d* (segment 26*da*), between lace retainers 27*d* and 28*b* (segment 26*db*), between lace retainers 28*b* and 27*e* (segment 26*eb*), between lace retainers 27*e* and 28*c* (segment 26*ec*), and between lace retainers 28*c* and 27*f* (segment 26*fc*).

When secured about the foot of a wearer of shoe 10, the lacing configuration shown in FIGS. 3 and 6 allows a smooth and continuous transfer of tensile forces along paths aligned with tensile restraints 31 and 32. This is shown diagrammatically in FIG. 7, another top view of shoe 10. Tensile restraints 31*a*1 through 31*c*2 of the first set are aligned on a diagonal path having a projection in a plantar plane that extends linearly from the medial forefoot region toward a lateral heel region. Tensile restraints 32*d*1 through 32*f*2 of the fourth set are aligned on that same diagonal path, and are linked to tensile restraints 31*a*1 through 31*c*2 by segments of lace 25 that are also aligned with that path (segments 25*ad*, 25*be*, and 25*cf*) or that only deviate slightly from that path (segments 25*bd* and 25*ce*). In a similar manner, tensile restraints 31*d*1 through 31*f*2 of the third set are aligned on a diagonal path having a projection in the plantar plane that extends linearly from the medial heel region toward the lateral forefoot region. Tensile restraints 32*a*1 through 32*c*2 of the second set are aligned on that same medial-heel-to-lateral-forefoot diagonal path, and are linked to tensile restraints 31*d*1 through 31*f*2 by segments of lace 26 that are also aligned with that path (segments 26*da*, 26*eb*, and 26*fc*) or that only deviate slightly from that path (segments 26*db* and 26*ec*).

Figure 7:
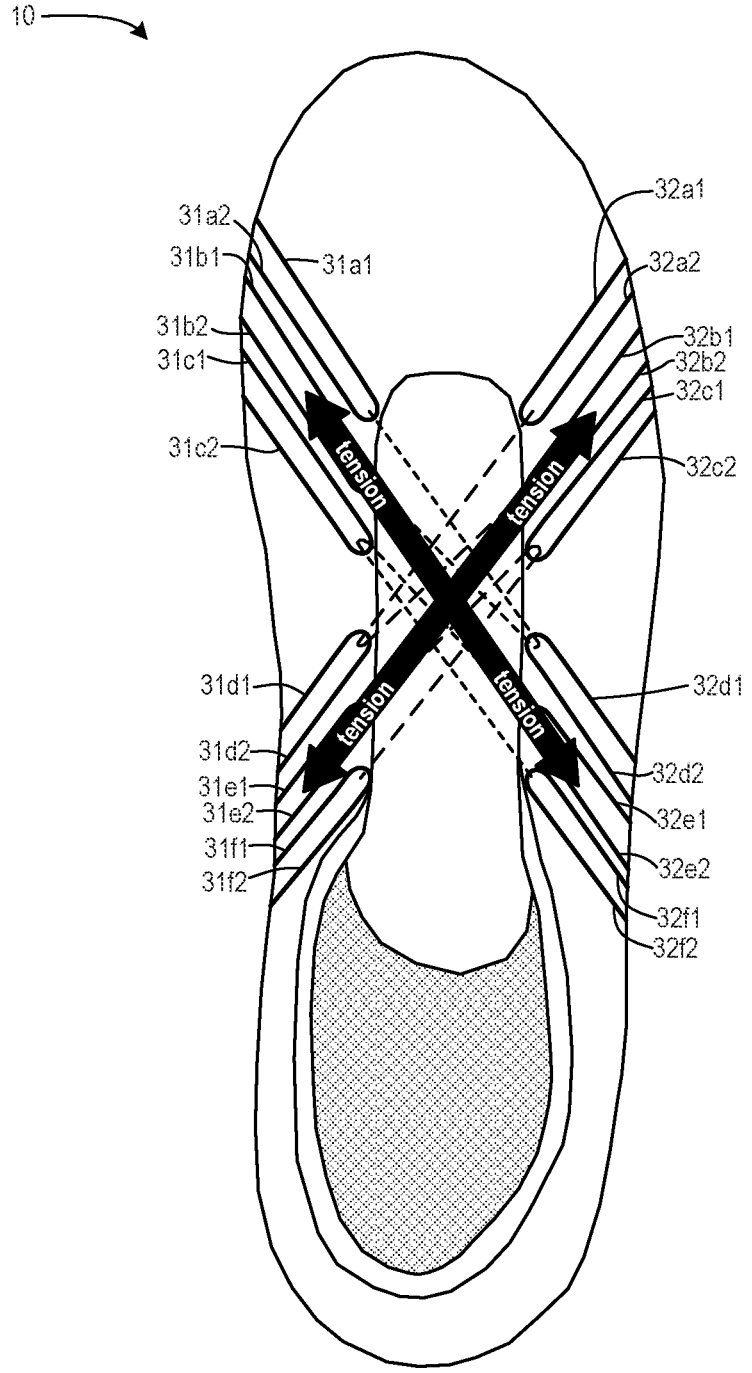
FIG. 7 is another top view of the shoe of FIG. 1.

The result is an alignment of tensile forces in the upper as shown by the large black arrows in FIG. 7. Two linear axes of tension extend diagonally across the shoe from one side to the other, and with anchors located in the forefoot and heel region. This secures the wearer foot relative to the sole structure in an efficient manner that emulates a four-point harness system found in high performance automobiles and aircraft. In some embodiments, and because other portions of upper 12 are more extensible and/or less tight than tensile restraints 31 and 32 and laces 25 and 26, the tensile forces through tensile restraints 31 and 32 and laces 25 and 26 are the primary tensile forces in upper 10.

Figure 8:
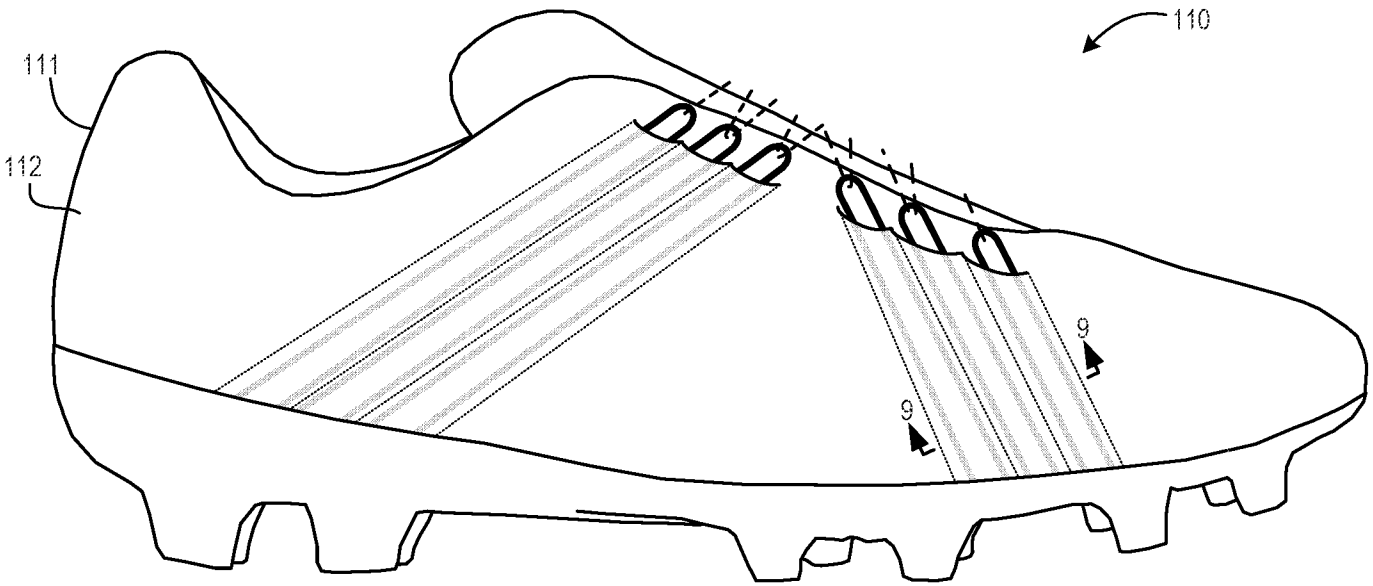
FIG. 8 is a lateral side view of a shoe according to some additional embodiments.
Figure 9:
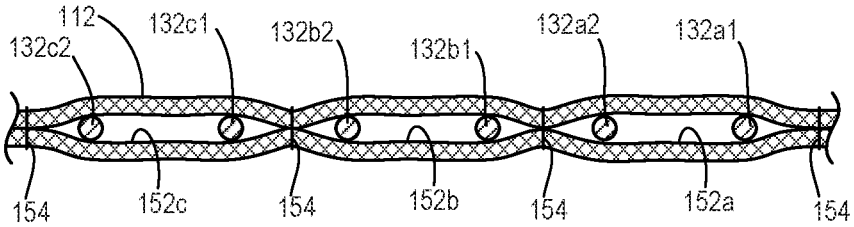
FIG. 9 is an area cross-sectional view from the location indicated in FIG. 8.

In some embodiments, tensile restraints may have some degree of freedom to move relative to a shell. In some such embodiments, for example, tensile restraints may extend through tunnels formed in a shell and be able to move somewhat within those tunnels. FIG. 8 is a lateral side view of a shoe 110 according to one such embodiments. Except as otherwise indicated, shoe 110 may be similar to shoe 10. Shoe 110 includes an upper 111 having a shell 112, lateral side tensile restraints similar to tensile restraints 32, and lateral side lace retainers similar to lace retainers 28. FIG. 9 is an area cross-sectional view from the location in FIG. 8. As seen in FIG. 9, tensile restraints 132*a*1 and 132*a*2 are contained in a tunnel 152*a*, tensile restraints 132*b*1 and 132*b*2 are contained in a tunnel 152*b*, and tensile restraints 132*c*1 and 132*c*2 are contained in a tunnel 152*c*. Tunnels 152*a* through 152*c* may be formed between layers of shell 112 by stitches 54. The other tensile restraints shown in FIG.

8 may have a similar configuration in corresponding similar tunnels, as may tensile restraints on a medial side of shoe 110.

In some embodiments, tensile restraints may pass through tunnels formed in an upper shell, but those tunnels may cover less of one or more tensile restraints than is shown in FIG. 8.

Figure 10:
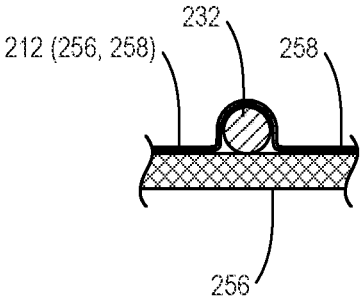
FIG. 10 is an area cross-sectional view of a shoe according to some further embodiments.

In some embodiments, and as shown in FIG. 10, one or more tensile restraints may be bonded to a surface of an upper shell by a sheet of polymer material. FIG. 10 is an area cross-sectional view showing tensile restraint 232 bonded to a first layer 256 of a shell 212 by a second layer of material 258 that has been heated and then cooled so as to fuse with first layer 256 and tensile restraint 232.

Figure 11:
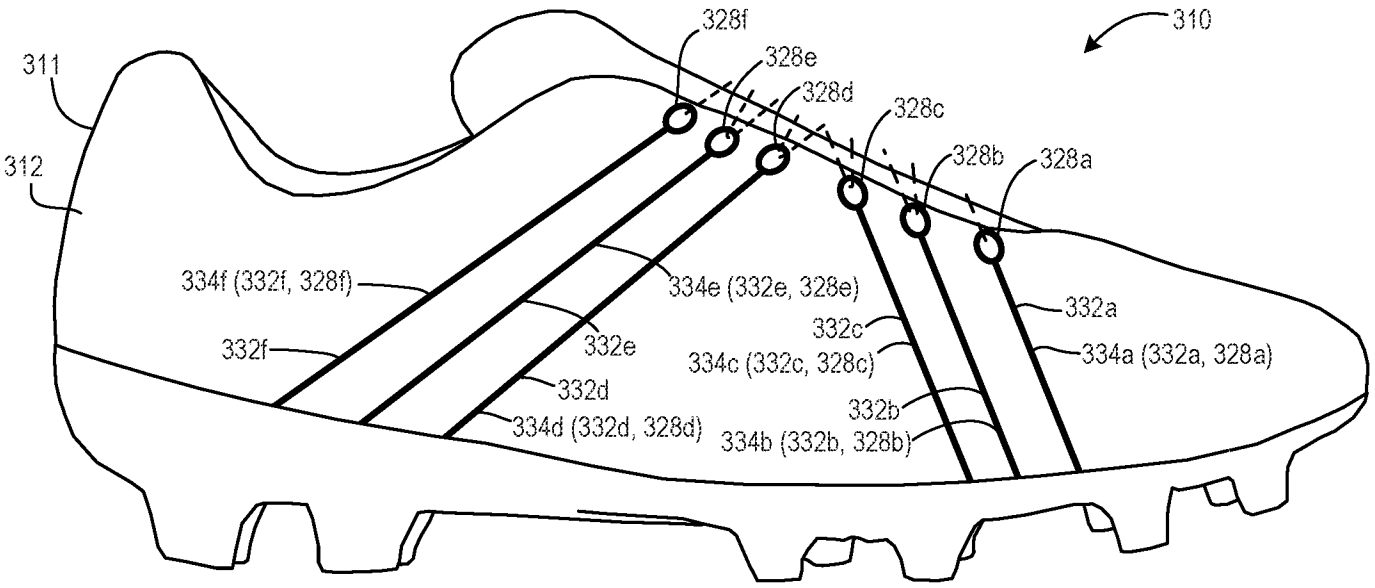
FIGS. 11 through 13 are lateral side views of shoes according to some additional embodiments.

In some embodiments, a single tensile restraint be connected to a lace retainer. FIG. 11 is a lateral side view of a shoe 310 according to one such embodiment. Except as otherwise indicated, shoe 310 may be similar to shoe 10. Shoe 310 includes lateral side tensile restraints 332*a* through 332*f* that are bonded to an exterior face of a shell 312 of an upper 311. Loops formed in the top ends of strands 334*a* through 334*f* of tensile restraints 332*a* through 332*f*, respectively, form lace retainers 328*a* through 328*f*. As with lace retainers in shoe 10, the portions of strands 334*a* through 334*f* forming lace retainers 328*a* through 328*f* are not bonded to the exterior surface of shell 312. Tensile restraints and lace retainers on a medial side of shoe 310 may have a configuration similar to that shown in FIG. 11.

Figure 12:
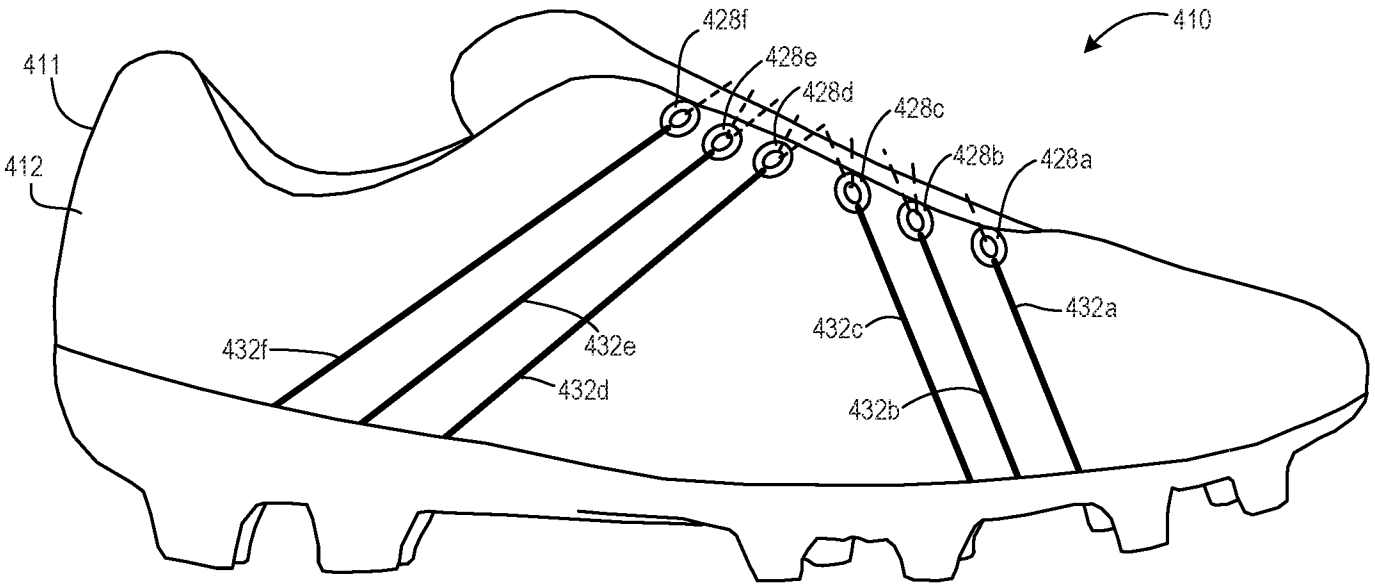

FIG. 12 is a lateral side view of a shoe 410 according to a further embodiment. Shoe 410 is similar to shoe 310 and includes lateral side tensile restraints 432*a* through 432*f* that are bonded to an exterior face of a shell 412 of an upper 411. Unlike shoe 310, however, each of lace retainers 428*a* through 428*f* is a reinforced zone of shell 412 through which a hole is created to allow passage or attachment of a lace. Tensile restraints 432*a* through 432*f* are attached at their top ends to the reinforcements corresponding lace retainers 428*a* through 428*f*, respectively. Tensile restraints and lace retainers on a medial side of shoe 410 may have a configuration similar to that shown in FIG. 12. In the embodiment of shoe 410, the reinforcements corresponding to the lace retainers are grommets formed from metal or other stiff material. In other embodiments, a single reinforcement (e.g., a sheet of metal or rigid plastic embedded in a shell 412) may correspond to multiple lace retainers.

Figure 13:
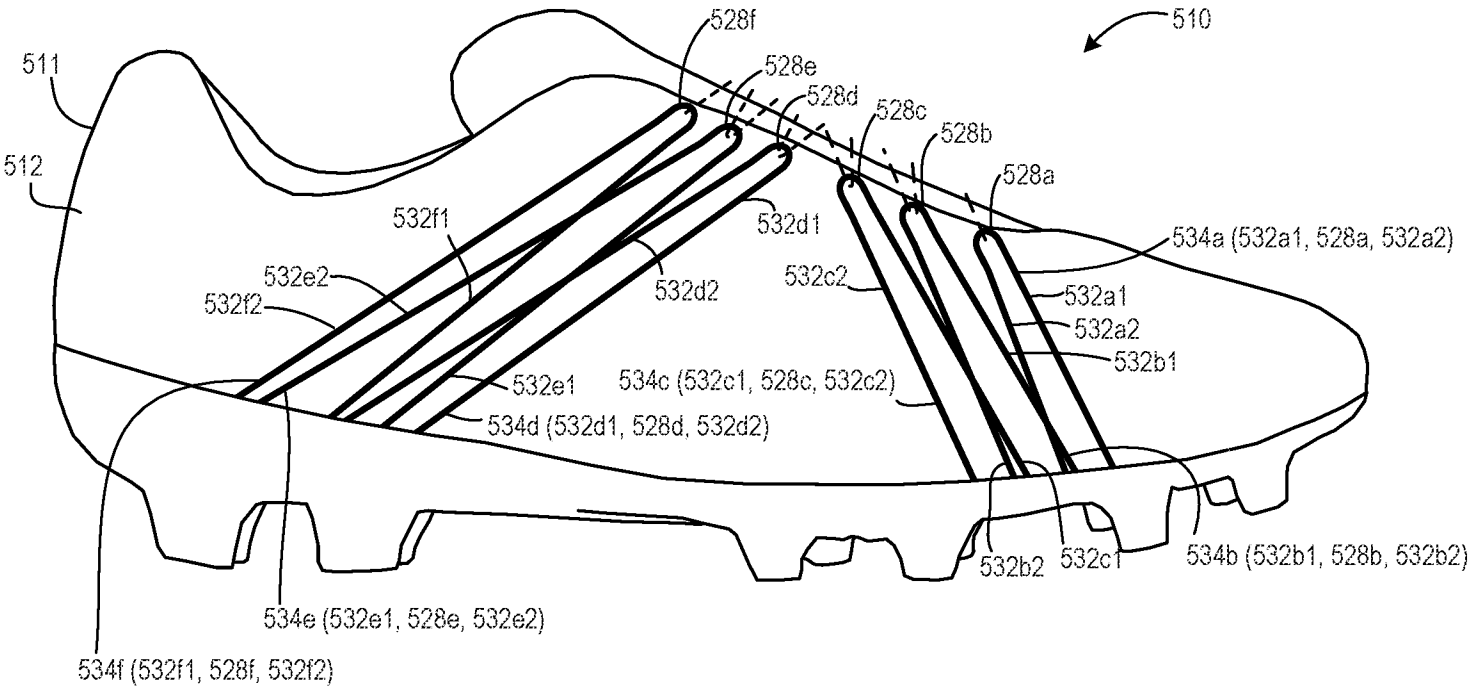

FIG. 13 is a lateral side view of a shoe 510 according to another embodiment. Shoe 510 is similar to shoe 10 and includes lateral side tensile restraints 532*a*1 through 532*f*2 attached to shell 512 of upper 511. Pairs of those tensile restraints and a corresponding one of lace retainers 528*a* through 528*f* are formed from a single one of strands 534*a* through 534*f*. Unlike shoe 10, however, pairs of tensile restraints spread outward at their bottom ends. As a result, some tensile restraints 532 within a set intersect. Tensile restraints and lace retainers on a medial side of shoe 410 may have a configuration similar to that shown in FIG. 13.

Other embodiments include numerous additional variations on the components and combinations described above. Without limitation, such variations may include one or more of the following.

In other embodiments, the number of tensile restraints in each set, and/or the number of tensile restraints coupled to a particular lace retainer, may vary from the configurations shown in the drawings. In some embodiments, for example, some or all sets of tensile restraints may only include a single tensile restraint. In some embodiments, some or all sets of tensile restraints may include more than three or six tensile restraints. In some embodiments, the number of tensile restraints associated with each of multiple lace retainers may be more than two. In some embodiments, the number of tensile restraints associated with a group of lace retainers may be less than the number of lace retainers in that group and/or may not be an integral multiple of the number of lace retainers in that group (e.g., one lace retainer in a group may have two associated tensile restraints, and each of the other lace retainers in that group may have one associated lace retainer).

In some embodiments, the number of lace retainers in a group may be more or less than three. In some such embodiments, all groups of lace retainers may not have the same number of lace retainers.

In some embodiments, tensile restraints may extend completely across an underside of an upper, and/or a lateral side tensile restraint and medial side tensile restraint may be joined under a footbed.

In some embodiments, other means may be used to tighten an upper and to connect sets of tensile restraints. For example, a first portion of a strap could be attached to top ends of a first set of tensile restraints anchored in a medial forefoot region, with a second portion of that strap attached to top ends of a fourth set of tensile restraints anchored in a lateral heel region. Those two strap portions could then be tightened to induce tension in the first and fourth sets. A first portion of another strap could be attached to top ends of a second set of tensile restraints anchored in a lateral forefoot region, with a second portion of that other strap attached to top ends of a third set of tensile restraints anchored in a medial heel region. Those two portions of the other strap could then be tightened to induce tension in the second and third sets.

In embodiments described above, lace retainers comprise eyes or loops. In some embodiments, alternate structures may be used as lace retainers. In some embodiments, for example, lace retainers may comprise hooks.

A shoe according to some embodiments may lack a tongue and tongue opening.

A shoe according to some embodiments may lack cleats.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, sub-combinations and permutations of features from herein-described embodiments are the within the scope of the invention. In the example embodiments included in the following list of example embodiments or in the claims, a reference to a potential or intended wearer or a user of a component does not require actual wearing or using of the component or the presence of the wearer or user as part of the example embodiment or claim.

Non-Limiting List of Example Embodiments

1. An article of footwear, comprising:
   a sole structure; and an upper including a shell, one or more laces, and first, second, third, and fourth sets of tensile restraints, each of the sets having one or more tensile restraints extending over and/or through a corresponding portion of the shell, and wherein the shell is engaged with the sole structure and defines an interior void configured to receive insertion of a user's foot, the shell includes first lace retainers on a medial side of an instep region, second lace retainers on a lateral side of the instep region, third lace retainers on the medial side of the instep region rearward of the first and second lace retainers, and fourth lace retainers on the lateral side the instep region rearward of the first and second lace retainers, the one or more tensile restraints of the first set are coupled to a first anchor region located in a medial forefoot portion of the article and to the first lace retainers, the one or more tensile restraints of the second set are coupled to a second anchor region located in a lateral forefoot portion of the article and to the second lace retainers, the one or more tensile restraints of the third set are coupled to a third anchor region located in a medial heel portion of the article and to the third lace retainers, and the one or more tensile restraints of the fourth set are coupled to a fourth anchor region located in a lateral heel portion of the article and to the fourth lace retainers, and each of the first lace retainers is directly connected by a segment of the one or more laces with one of the fourth lace retainers, each of the fourth lace retainers is directly connected by a segment of the one or more laces with one of the first lace retainers, each of the second lace retainers is directly connected by a segment of the one or more laces with one of the third lace retainers, and each of the third lace retainers is directly connected by a segment of the one or more laces with one of the second lace retainers.

2. The article of footwear of embodiment 1, wherein each of the first anchor region, the second anchor region, the third anchor region, and the fourth anchor region is located under a footbed of the upper.

3. The article of footwear of any one of embodiment 1 or embodiment 2, wherein the first set of tensile restraints and the fourth set of tensile restraints are aligned on a first diagonal path having a projection, in a plantar plane, that extends linearly from a medial forefoot region to a lateral heel region, and the second set of tensile restraints and the third set of tensile restraints are aligned on a second diagonal path having a projection, in the plantar plane, that extends linearly from a lateral forefoot region toward a medial heel region.

4. The article of footwear of any one of embodiment 1 through embodiment 3, wherein the first, second, third, and fourth sets of tensile restraints and the one or more laces are configured so that, upon securing the one or more laces, two linear axes of tension with anchors located in the forefoot and heel region extend diagonally across the article from one side to the other.

5. The article of footwear of any one of embodiment 1 through embodiment 4, wherein the tensile restraints of the first, second, third, and fourth sets extend to a lower edge of the shell.

6. The article of footwear of any one of embodiment 1 through embodiment 4, wherein the tensile restraints of the first, second, third, and fourth sets extend to the sole structure.

7. The article of footwear of any one of embodiment 1 through embodiment 6, wherein the tensile restraints of the first and third sets are the only tensile restraints extending between the sole structure and any of the first or third lace retainers, and wherein the tensile restraints of the second and fourth sets are the only tensile restraints extending between the sole structure and any of the second or fourth lace retainers.

8. The article of footwear of any one of embodiment 1 through embodiment 7, wherein the tensile restraints of the first and third sets are the only tensile restraints on a medial side of the upper, and wherein the tensile restraints of the second and fourth sets are the only tensile restraints on a lateral side of the upper.

9. The article of footwear of any one of embodiment 1 through embodiment 8, wherein each of the tensile restraints is formed from a material that is less extensible than material forming the corresponding portion of the shell over and/or through which the tensile restraint extends.

10. The article of footwear of any one of embodiment 1 through embodiment 9, wherein each of the tensile restraints has a length along a lengthwise axis, a cross section perpendicular to its lengthwise axis, and a largest dimension across the cross section that is no greater than one tenth of the length.

11. The article of footwear of any one of embodiment 1 through embodiment 10, wherein each of the tensile restraints is a strand comprising one or more filaments and/or fibers.

12. The article of footwear of any one of embodiment 1 through embodiment 11, wherein the article lacks a lace portion extending between any of the first lace retainers and any of the second lace retainers, and wherein the article lacks a lace portion extending between any of the third lace retainers and any of the fourth lace retainers.

13. The article of footwear of any one of embodiment 1 through embodiment 9, wherein no portion of the one or more laces extends linearly, and without a change in direction or passing through an intervening lace retainer, between any of the first lace retainers and any of the second lace retainers.

14. The article of footwear of any one of embodiment 1 through embodiment 14, wherein no portion of the one or more laces extends linearly, and without a change in direction or passing through an intervening lace retainer, between any of the third lace retainers and any of the fourth lace retainers.

15. The article of footwear of any one of embodiment 1 through embodiment 14, wherein the one or more laces comprises separate first and second laces, wherein segments of the first lace connects first lace retainers and fourth lace retainers, and wherein segments of the second lace connects second lace retainers and third lace retainers.

16. The article of footwear of any one of embodiment 1 through embodiment 15, wherein one or more of the tensile restraints is bonded to the shell.

17. The article of footwear of any one of embodiment 1 through embodiment 15, wherein one or more of the tensile restraints extends through a corresponding tunnel formed in the shell.

18. The article of footwear of any one of embodiment 1 through embodiment 17, wherein each of the tensile restraints of the first set is directly attached to one of the first lace retainers, each of the tensile restraints of the second set is directly attached to one of the second lace retainers, each of the tensile restraints of the third set is directly attached to one of the third lace retainers, and each of the tensile restraints of the fourth set is directly attached to one of the fourth lace retainers.

19. The article of footwear of any one of embodiment 1 through embodiment 18, wherein each of the first lace retainers is formed, with a different pair of the tensile restraints of the first set, from a single continuous strand, each of the second lace retainers is formed, with a different pair of the tensile restraints of the second set, from a single continuous strand, each of the third lace retainers is formed, with a different pair of the tensile restraints of the third set, from a single continuous strand, and each of the fourth lace retainers is formed, with a different pair of the tensile restraints of the fourth set, from a single continuous strand.

20. The article of footwear of any one of embodiment 1 through embodiment 18, wherein the first set includes multiple tensile restraints, each of the tensile restraints of the first set corresponding to a different one of the first lace retainers, the second set includes multiple tensile restraints, each of the tensile restraints of the second set corresponding to a different one of the second lace retainers, the third set includes multiple tensile restraints, each of the tensile restraints of the third set corresponding to a different one of the third lace retainers, and the fourth set includes multiple tensile restraints, each of the tensile restraints of the fourth set corresponding to a different one of the fourth lace retainers.

21. The article of footwear of any one of embodiment 1 through embodiment 20 wherein each of the tensile restraints includes a loop in a terminal end and is coupled to a corresponding one the laces retainers by forming at least a portion of the corresponding lace retainer.

22. The article of footwear of any one of embodiment 1 through embodiment 21, wherein the shell includes reinforced zones in the instep region, each of the reinforced zones having a rigidity greater than a rigidity of adjacent portions of the shell, each of the lace retainers is formed in one of the reinforced zones, and each of the tensile restraints is attached to one of the reinforced zones.

23. An article of footwear, comprising:

a sole structure; and an upper including a shell and first, second, third, and fourth sets of tensile restraints, each of the sets having one or more tensile restraints extending over and/or through a corresponding portion of the shell, and wherein the shell is engaged with the sole structure and defines an interior void configured to receive insertion of a user's foot, the one or more tensile restraints of the first set are coupled to a first anchor region located in a medial forefoot portion of the article and to a forward part of a medial side of an instep region of the shell, the one or more tensile restraints of the second set are coupled to a second anchor region located in a lateral forefoot portion of the article and to a forward part of a lateral side of the instep region, the one or more tensile restraints of the third set are coupled to a third anchor region located in a medial heel portion of the article and to a rear part of the medial side of the instep region, the one or more tensile restraints of the fourth set are coupled to a fourth anchor region located in a lateral heel portion of the article and to a rear part of the lateral side of the instep region, and the first, second, third, and fourth sets are configured so that, upon cinching of lace segments connecting the medial and the lateral sides of the instep region, two linear axes of tension with anchors located in the forefoot and heel region extend diagonally across the article from one side to the other.

24. The article of footwear of embodiment 23, wherein the forward part of the medial side of the instep region does not overlap with the rear part of the medial side of the instep region, and wherein the forward part of the lateral side of the instep region does not overlap with the rear part of the lateral side of the instep region.

25. The article of footwear any one of embodiment 23 or embodiment 24, wherein each of the first anchor region, the second anchor region, the third anchor region, and the fourth anchor region is located under a footbed of the article.

26. The article of footwear of any one of embodiment 23 through embodiment 25, wherein the tensile restraints of the first and third sets are the only tensile restraints extending between the sole structure and the medial side of the instep region, and wherein the tensile restraints of the second and fourth sets are the only tensile restraints extending between the sole structure and the lateral side of the instep region.

27. The article of footwear of any one of embodiment 23 through embodiment 26, wherein the tensile restraints of the first and third sets are the only tensile restraints on a medial side of the upper, and wherein the tensile restraints of the second and fourth sets are the only tensile restraints on a lateral side of the upper.

28. The article of footwear of any one of embodiment 23 through embodiment 27, wherein each of the tensile restraints is formed from a material that is less extensible than material forming the corresponding portion of the shell over and/or through which the tensile restraint extends.

29. The article of footwear of any one of embodiment 23 through embodiment 28, wherein each of the tensile restraints has a length along a lengthwise axis, a cross section perpendicular to its lengthwise axis, and a largest dimension across the cross section that is no greater than one tenth of the length.

30. The article of footwear of any one of embodiment 23 through embodiment 29, wherein each of the tensile restraints is a strand comprising one or more filaments and/or fibers.

31. The article of footwear of any one of embodiment 23 through embodiment 30, wherein one or more of the tensile restraints is bonded to the shell.

32. The article of footwear of any one of embodiment 23 through embodiment 30, wherein one or more of the tensile restraints extends through a corresponding tunnel formed in the shell.

33. An article of footwear, comprising:

a sole structure; and an upper including a shell and first, second, third, and fourth sets of tensile restraints, each of the sets having one or more tensile restraints extending over and/or through a corresponding portion of the shell, and wherein the shell is engaged with the sole structure and defines an interior void configured to receive insertion of a user's foot, the one or more tensile restraints of the first set are coupled to a first anchor region located in a medial forefoot portion of the article and to a forward part of a medial side of an instep region of the upper, the one or more tensile restraints of the second set are coupled to a second anchor region located in a lateral forefoot portion of the article and to a forward part of a lateral side of the instep region, the one or more tensile restraints of the third set are coupled to a third anchor region located in a medial heel portion of the article and to a rear part of the medial side of the instep region, the one or more tensile restraints of the fourth set are coupled to a fourth anchor region located in a lateral heel portion of the article and to a rear part of the lateral side of the instep region, the tensile restraints of the first and third sets are the only tensile restraints extending between the sole structure and the medial side of the instep region, and the tensile restraints of the second and fourth sets are the only tensile restraints extending between the sole structure and the lateral side of the instep region.

34. The article of footwear of embodiment 33, wherein the forward part of the medial side of the instep region does not overlap with the rear part of the medial side of the instep region, and wherein the forward part of the lateral side of the instep region does not overlap with the rear part of the lateral side of the instep region.

35. The article of footwear of any one of embodiment 33 or embodiment 34, wherein each of the first anchor region, the second anchor region, the third anchor region, and the fourth anchor region is located under a footbed of the article.

36. The article of footwear of any one of embodiment 33 through embodiment 35, wherein the tensile restraints of the first and third sets are the only tensile restraints on a medial side of the upper, and wherein the tensile restraints of the second and fourth sets are the only tensile restraints on a lateral side of the upper.

37. The article of footwear of any one of embodiment 33 through embodiment 36, wherein each of the tensile restraints is formed from a material that is less extensible than material forming the corresponding portion of the shell over and/or through which the tensile restraint extends.

38. The article of footwear of any one of embodiment 33 through embodiment 37, wherein each of the tensile restraints has a length along a lengthwise axis, a cross section perpendicular to its lengthwise axis, and a largest dimension across the cross section that is no greater than one tenth of the length.

39. The article of footwear of any one of embodiment 33 through embodiment 38, wherein each of the tensile restraints is a strand comprising one or more filaments and/or fibers.

40. The article of footwear of any one of embodiment 33 through embodiment 39, wherein one or more of the tensile restraints is bonded to the shell.

41. The article of footwear of any one of embodiment 33 through embodiment 39, wherein one or more of the tensile restraints extends through a corresponding tunnel formed in the shell.

42. The article of footwear of any one of embodiment 33 through embodiment 41, wherein no tensile restraint of the first set intersects a tensile restraint of the third set, and wherein no tensile restraint of the second set intersects a tensile restraint of the fourth set.

43. An upper for an article of footwear, the upper comprising a shell and first, second, third, and fourth sets of tensile restraints, each of the sets having one or more tensile restraints extending over and/or through a corresponding portion of the shell, and wherein the one or more tensile restraints of the first set extend from a medial phalangeal and/or medial tarso-phalangeal region of the shell to an instep region of the shell, the one or more tensile restraints of the second set extend from a lateral phalangeal and/or lateral tarso-phalangeal region of the shell to the instep region of the shell, the one or more tensile restraints of the third set extend from a medial heel region of the shell to the instep region of the shell, and the one or more tensile restraints of the fourth set extend from a lateral heel region of the shell to the instep region of the shell, a rearward-most tensile restraint of the first set and a forward-most tensile restraint of the third set bound a region of the shell medial side lacking any tensile restraints extending between a bottom edge of the shell and the instep region, and a rearward-most tensile restraint of the second set and a forward-most tensile restraint of the fourth set bound a region of the shell lateral side lacking any tensile restraints extending between the bottom edge of the shell and the instep region.

44. An article of footwear comprising the upper of claim 43 and a sole structure engaged with the upper.

45. An article of footwear, comprising:

a sole structure; and an upper including a shell and first, second, third, and fourth sets of tensile restraints, each of the sets having one or more tensile restraints extending over and/or through a corresponding portion of the shell, and wherein the shell is engaged with the sole structure and defines an interior void configured to receive insertion of a user's foot, the first set of tensile restraints and the fourth set of tensile restraints are aligned on a first diagonal path having a projection, in a plantar plane, that extends linearly from a medial forefoot region to a lateral heel region, and the second set of tensile restraints and the third set of tensile restraints are aligned on a second diagonal path having a projection, in the plantar plane, that extends linearly from a lateral forefoot region toward a medial heel region.

46. The article of footwear of embodiment 45, wherein the first, second, third, and fourth sets of tensile restraints and one or more laces are configured so that, upon securing the one or more laces, two linear axes of tension with anchors located in the forefoot and heel region extend diagonally across the article from one side to the other.

47. An article of footwear, comprising:

a sole structure; and an upper including a shell and first, second, third, and fourth sets of tensile restraints, each of the sets having one or more tensile restraints extending over and/or through a corresponding portion of the shell, and wherein the shell is engaged with the sole structure and defines an interior void configured to receive insertion of a user's foot, and the first, second, third, and fourth sets of tensile restraints are configured so that, upon securing of means to tighten the upper and connect the sets of tensile restraints, two linear axes of tension with anchors located in the forefoot and heel region extend diagonally across the article from one side to the other.

48. The article of footwear of embodiment 47, wherein the means to tighten the upper and connect the sets of tensile restraints comprise one or more laces.

The invention claimed is:

1. An article of footwear, comprising:

a sole structure; and an upper including a shell, one or more laces, and first, second, third, and fourth sets of tensile restraints, each of the sets having one or more tensile restraints extending over and/or through a corresponding portion of the shell, and wherein the shell is engaged with the sole structure and defines an interior void configured to receive insertion of a user's foot, the shell includes first lace retainers on a medial side of an instep region, second lace retainers on a lateral side of the instep region, third lace retainers on the medial side of the instep region rearward of the first and second lace retainers, and fourth lace retainers on the lateral side the instep region rearward of the first and second lace retainers, the one or more tensile restraints of the first set are coupled to a first anchor region located in a medial forefoot portion of the article and to the first lace retainers, the one or more tensile restraints of the second set are coupled to a second anchor region located in a lateral forefoot portion of the article and to the second lace retainers, the one or more tensile restraints of the third set are coupled to a third anchor region located in a medial heel portion of the article and to the third lace retainers, and the one or more tensile restraints of the fourth set are coupled to a fourth anchor region located in a lateral heel portion of the article and to the fourth lace retainers, and each of the first lace retainers is directly connected by a segment of the one or more laces with one of the fourth lace retainers, each of the fourth lace retainers is directly connected by a segment of the one or more laces with one of the first lace retainers, each of the second lace retainers is directly connected by a segment of the one or more laces with one of the third lace retainers, and each of the third lace retainers is directly connected by a segment of the one or more laces with one of the second lace retainers, wherein each of the tensile restraints of the first set is directly attached to one of the first lace retainers, each of the tensile restraints of the second set is directly attached to one of the second lace retainers, each of the tensile restraints of the third set is directly attached to one of the third lace retainers, and each of the tensile restraints of the fourth set is directly attached to one of the fourth lace retainers.

2. The article of footwear of claim 1, wherein the tensile restraints of the first, second, third, and fourth sets extend to a lower edge of the shell.

3. The article of footwear of claim 1, wherein the tensile restraints of the first, second, third, and fourth sets extend to the sole structure.

4. The article of footwear of claim 1, wherein one or more of the tensile restraints is bonded to the shell.

5. The article of footwear of claim 1, wherein one or more of the tensile restraints extends through a corresponding tunnel formed in the shell.

6. The article of footwear of claim 1, wherein each of the first lace retainers is formed, with a different pair of the tensile restraints of the first set, from a single continuous strand, each of the second lace retainers is formed, with a different pair of the tensile restraints of the second set, from a single continuous strand, each of the third lace retainers is formed, with a different pair of the tensile restraints of the third set, from a single continuous strand, and each of the fourth lace retainers is formed, with a different pair of the tensile restraints of the fourth set, from a single continuous strand.

7. The article of footwear of claim 1, wherein the first set includes multiple tensile restraints, each of the tensile restraints of the first set corresponding to a different one of the first lace retainers, the second set includes multiple tensile restraints, each of the tensile restraints of the second set corresponding to a different one of the second lace retainers, the third set includes multiple tensile restraints, each of the tensile restraints of the third set corresponding to a different one of the third lace retainers, and the fourth set includes multiple tensile restraints, each of the tensile restraints of the fourth set corresponding to a different one of the fourth lace retainers.

8. The article of footwear of claim 1, wherein each of the tensile restraints includes a loop in a terminal end and is coupled to a corresponding one the lace retainers by forming at least a portion of the corresponding lace retainer.

9. The article of footwear of claim 1, wherein the shell includes reinforced zones in the instep region, each of the reinforced zones having a rigidity greater than a rigidity of adjacent portions of the shell, each of the lace retainers is formed in one of the reinforced zones, and each of the tensile restraints is attached to one of the reinforced zones.

10. An article of footwear, comprising:

a sole structure; and an upper including a shell and first, second, third, and fourth sets of tensile restraints, each of the sets having one or more tensile restraints extending over and/or through a corresponding portion of the shell, and wherein the shell is engaged with the sole structure and defines an interior void configured to receive insertion of a user's foot, the one or more tensile restraints of the first set are coupled to a first anchor region located in a medial forefoot portion of the article and to a forward part of a medial side of an instep region of the shell, the one or more tensile restraints of the second set are coupled to a second anchor region located in a lateral forefoot portion of the article and to a forward part of a lateral side of the instep region, the one or more tensile restraints of the third set are coupled to a third anchor region located in a medial heel portion of the article and to a rear part of the medial side of the instep region, the one or more tensile restraints of the fourth set are coupled to a fourth anchor region located in a lateral heel portion of the article and to a rear part of the lateral side of the instep region, and the first, second, third, and fourth sets are configured so that, upon cinching of lace segments connecting the medial and the lateral sides of the instep region, two linear axes of tension with anchors located in the forefoot and heel region extend diagonally across the article from one side to the other;

wherein each of the tensile restraints is a strand comprising one or more filaments and/or fibers.

11. The article of footwear of claim 10, wherein one or more of the tensile restraints is bonded to the shell.

12. The article of footwear of claim 10, wherein one or more of the tensile restraints extends through a corresponding tunnel formed in the shell.

* * * * *